United States Patent [19]

Coles

[11] 3,943,811

[45] Mar. 16, 1976

[54] KEYBOARD TYPE MUSICAL INSTRUMENT

[76] Inventor: Donald K. Coles, 2505 Capitol Ave., Fort Wayne, Ind. 46806

[22] Filed: Aug. 12, 1974

[21] Appl. No.: 496,806

[52] U.S. Cl. ..... 84/1.01; 84/423; 84/451
[51] Int. Cl.[2] ..... G10C 3/12; G10H 1/00
[58] Field of Search ..... 84/1.01, 1.24, 445–449, 84/1.08, 423, 428, 451

[56] References Cited

UNITED STATES PATENTS

| | | | |
|---|---|---|---|
| 2,484,930 | 10/1949 | Cornelius | 84/1.01 X |
| 2,539,130 | 1/1951 | Grudin | 84/445 UX |
| 3,023,659 | 3/1962 | Bode | 84/445 |
| 3,030,848 | 4/1962 | Wick | 84/445 |
| 3,141,371 | 7/1964 | Coles | 84/448 |
| 3,379,087 | 4/1968 | Weitzner | 84/445 X |
| 3,610,800 | 10/1971 | Deutsch | 84/1.01 |
| 3,674,907 | 7/1972 | Derry | 84/1.01 |
| 3,800,060 | 3/1974 | Hallman, Jr. | 84/1.24 |
| 3,824,325 | 7/1974 | Obayashi et al. | 84/1.01 |
| 3,836,909 | 9/1974 | Cockerell | 84/1.01 X |
| 3,845,685 | 11/1974 | Coles | 84/451 |
| 3,865,004 | 2/1975 | Coles | 84/423 |

*Primary Examiner*—L. T. Hix
*Assistant Examiner*—Stanley J. Witkowski

[57] ABSTRACT

The musical instrument has a keyboard which may be arranged to have either seven or five lower digitals per octave span. The musical tones are electrically keyed by means of digital switches. A scale selector switch changes the connections between the digital switches and the tone generator circuits so that either the seven tone diatonic scale or a pentatonic scale is played on consecutive lower digitals of the keyboard.

The top parts of the upper digitals are easily removable and interchangeable. Most of the upper digitals are black. When the keyboard is arranged for playing in a pentatonic scale, the E# upper digital in each octave is white, serving as a landmark for the player. When the keyboard is arranged for playing in the diatonic scale, the inactive E# and B# digitals are white.

4 Claims, 14 Drawing Figures

KEYBOARD TYPE MUSICAL INSTRUMENT

BACKGROUND OF THE INVENTION

1. Field of the Invention

My musical instrument has a keyboard with only five lower digitals per octave span, to play a pentatonic scale. In the preferred embodiment, one upper digital is disposed between each two adjacent lower digitals. The top parts of the upper digitals are easily removable and interchangeable, so that the keyboard can be rearranged with seven lower digitals per octave span, to play the diatonic scale.

The musical tones are electrically keyed. A scale selector switch is provided to switch from one pentatonic scale to another, or to the diatonic scale.

2. Description of the Prior Art

The origin of the standard keyboard is obscure. The article on "Keyboard" in the 1954 edition of Grove's Dictionary of Music and Musicians states, "We are without definite information as to the origin of the keyboard . . . The first keyboard would be diatonic . . . When the row of sharps was introduced, and whether at once or by degrees, we do not know. We find them complete in a trustworthy pictorial representation of the 15th century." Pitch selecting mechanisms were developed in the 19th century. Organs with pentatonic and hexatonic keyboards are described in my copending U.S. patent applications Ser. No. 395,002, filed 9-7-73, and now U.S. Pat. No. 3,845,685, and Ser. No. 486,973, filed 7-10-74 and now U.S. Pat. No. 3,865,004.

I have found that children rapidly acquire an appreciation of music if they are encouraged to experiment and improvise simple melodies and harmonies in a pentatonic scale. Elimination of the two semitonal intervals from the diatonic scale decreases the likelihood of getting unwanted pitch combinations and greatly increases the ability to pick out a tune. Early training of relatively young children is possible if they are allowed to sing songs and simultaneously play them on a keyboard instrument. The keyboard serves as a direct graphical representation of tonal relationships for the singer. This approach, attempted on the traditional keyboard, is marred by the danger of hitting the wrong digital, with its distracting influences. The danger is greatly reduced on my simplified keyboard, where the number of either lower or upper digitals per octave span is equal to the number of fingers on the hand.

Moreover, children's small hands can span an octave more easily if the number of lower digitals in a keyboard is reduced below the traditional number of seven per octave span.

When children are learning sight singing, they become confused by the traditional musical notation which sometimes represents a particular note on the line of a staff, and at other times in a space between the lines. More confusion is caused when a boy who has been trained to sing on the treble staff must learn to sing on the bass staff, where the lines and spaces are differently labeled. In music written for my pentatonic instrument, some of my notes are always assigned to lines, the other notes are always assigned to spaces. Moreover, the labeling of the lines in the lower staff is the same as the labeling in the upper staff.

SUMMARY OF THE INVENTION

My invention is a keyboard-type musical instrument such as a piano or organ which is specially adapted to play a pentatonic scale on the lower digitals. The keyboard contains five lower digitals per octave span, where the length of an octave span is defined as the center-to-center distance between two digitals which control tones an octave apart. In the preferred embodiment, the number of upper digitals per octave span is five: if both lower and upper digitals are included, the number of digitals per octave span is ten. (See FIG. 3)

The instrument contains an absolute pitch selecting mechanism which uniformly shifts upward or downward the pitches controlled by the various digitals of the keyboard.

One object of my invention is to reduce the octave span of the keyboard so that small hands can span the octave.

A second object of my invention is to reduce the complexity of the musical scale available on the lower digitals, to encourage melodic and harmonic improvisation by children.

A third object of my invention is to provide a simple pentatonic notation which is compatible with the hexatonic notation described in my above-mentioned U.S. Pat. No. 3,865,004. In these notations, notes of the major triad are always positioned on lines of a staff and the other notes are always located in spaces between lines. Moreover, a particular note of the muscial scale is always located in the same position on a lower staff as it is on an upper staff.

A fourth object of my invention is to provide a scale selecting mechanism so that traditional diatonic music may be played on the lower digitals of the keyboard.

A fifth object of my invention is to provide removable and interchangeable upper digitals that may be used as landmarks on the keyboard when it is arranged for either five or seven lower digitals per octave span.

DESCRIPTION OF THE PREFERRED EMBODIMENT

Figure 1:
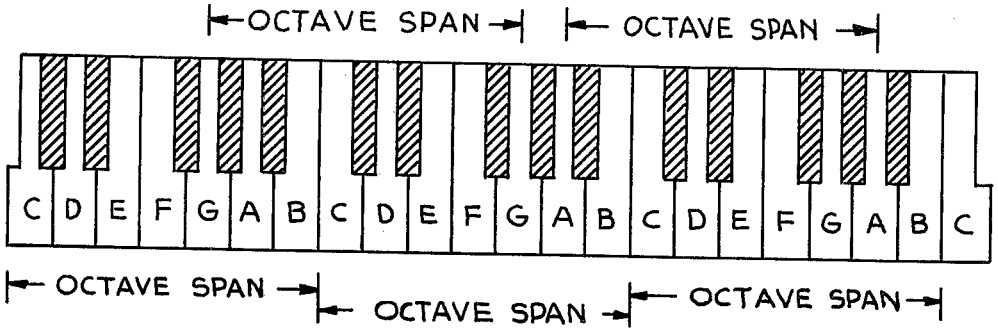
FIG. 1 shows the traditional keyboard.

Referring to FIG. 1, the traditional keyboard has seven lower digitals per octave span. To avoid ambiguity, I define the octave span as the center-to-center distance between digitals which control tones an octave apart. Although defined as a center-to-center distance, this distance may of course be measured between any corresponding points of the two digitals, or between the cracks to the immediate left or right of the digitals.

Present keyboard instruments employ an equitempered scale with twelve different pitches per octave span separated by equal musical intervals of a semitone. The traditional keyboard with its seven lower digitals and five upper digitals can play each of these twelve pitches per octave span. In FIG. 1 the seven lower digitals to the left play the diatonic scale, which is characterized by the sequence of musical intervals of 1-2-1-2-2-2-1 semitones.

These intervals add up to 12 semitones, so that the pitch to the right of the last interval is just one octave higher than the pitch preceding the first interval of the sequence. The next seven lower digitals repeat the diatonic scale an octave higher, and so on.

In order to avoid other ambiguities, I generally use the terms "tone" and "pitch" in a relative way to describe a musical sound relative to other tones in a musical scale. When I intend the term pitch in an absolute sense, I use the specific term "absolute pitch". A musical scale is characterized by the musical intervals between its tones, not by their absolute pitch.

Figure 2:
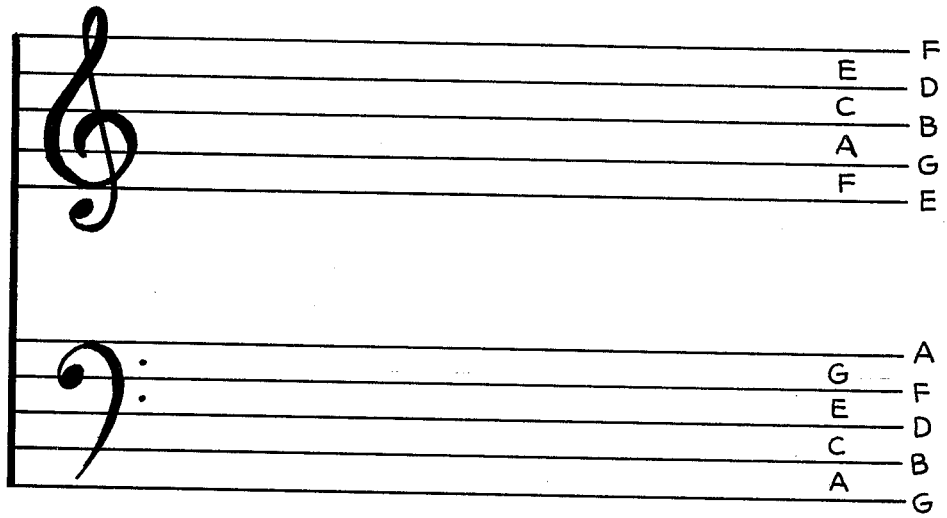
FIG. 2 shows the labeling of the lines and spaces in the traditional treble and bass staves.

I reserve the term "note" for the label itself (such as C or D) which is used to specify a digital and the tone it activates. When a staff is used to record music on paper or blackboard, each musical tone is indicated by a note on the staff. Starting at the left of the keyboard in FIG. 1, the seven lower digitals included in an octave span are labeled C, D. E. F, G, A, B. The positions of the seven different notes on the treble and bass clefs are indicated in FIG. 2.

The traditional system of notation has the serious disadvantage that a particular note may be positioned on either a line or a space, and it is positioned differently in the treble and bass staves. For example, the note E is placed on the bottom line of the treble staff, but also in the fourth space up of the treble staff and the third space up on the bass staff. Children find this notation confusing, especially when learning to sing at sight or to play by ear. The large number of notes in the diatonic scale and the large distance between notes an octave apart add to their difficulties.

Figure 3:
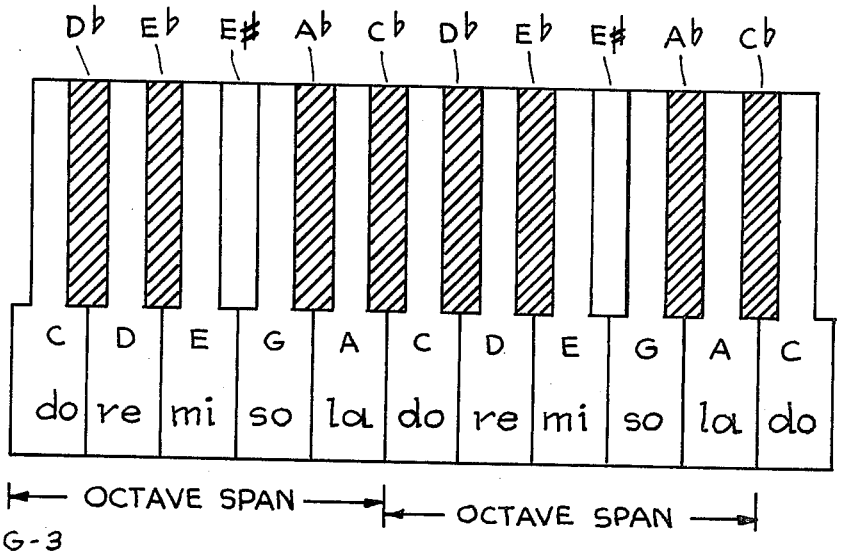
FIG. 3 shows my special keyboard for use with the tonal pentatonic scale.

In an attempt to reduce these difficulties, I have constructed an electrically keyed organ having a keyboard with a reduced octave span containing only five lower digitals. These digitals play the tonal pentatonic scale which is a natural scale comparatively easy to sing. The keyboard contains one upper digital between each pair of adjacent lower digitals, making a total of 10 digitals per octave span. The instrument includes an absolute pitch selector switch. This allows tonal pentatonic music at any absolute pitch to be written in the key of C, with a fixed sol-fa syllable assigned to each lower digital, as shown in FIG. 3. In accordance with U.S. custom, a fixed letter label may also be assigned to each lower digital.

Depending on where one starts it, the tonal pentatonic scale may be considered to be made up of the five tones do, re, mi, so, la of the diatonic scale, or five tones do, re, fa, so, la of the diatonic scale. I prefer the first of these alternatives as a basis for my system of pentatonic notation. Thus six consecutive lower digitals, labeled C, D, E, G, A, C control tones with the sequence of musical intervals 2-2-3-2-3 semitones.

In the three cases above where the interval between adjacent pitches of the pentatonic scale is two semitones, there can be only a single pitch. I label these three pitches D♭, E♭, and A♭: they are controlled by three upper digitals located between the adjacent lower digital pairs C-D, D-E, and G-A respectively. In the two cases where the interval between adjacent pitches of the pentatonic scale is three semitones, there is a choice between two pitches to be controlled by the single upper digital located between the adjacent lower digital pairs E-G and A-C. In a preferred embodiment these pitches correspond to the two pitches F, B of the diatonic scale which are missing from the pentatonic scale. Since F is one semitone above E, and B is one semitone below C, these pitches are naturally labeled E# and C♭ respectively. FIG. 3 shows the tonic sol-fa assignment to each lower digital and the above letter labels for both lower and upper digitals.

Figure 4:
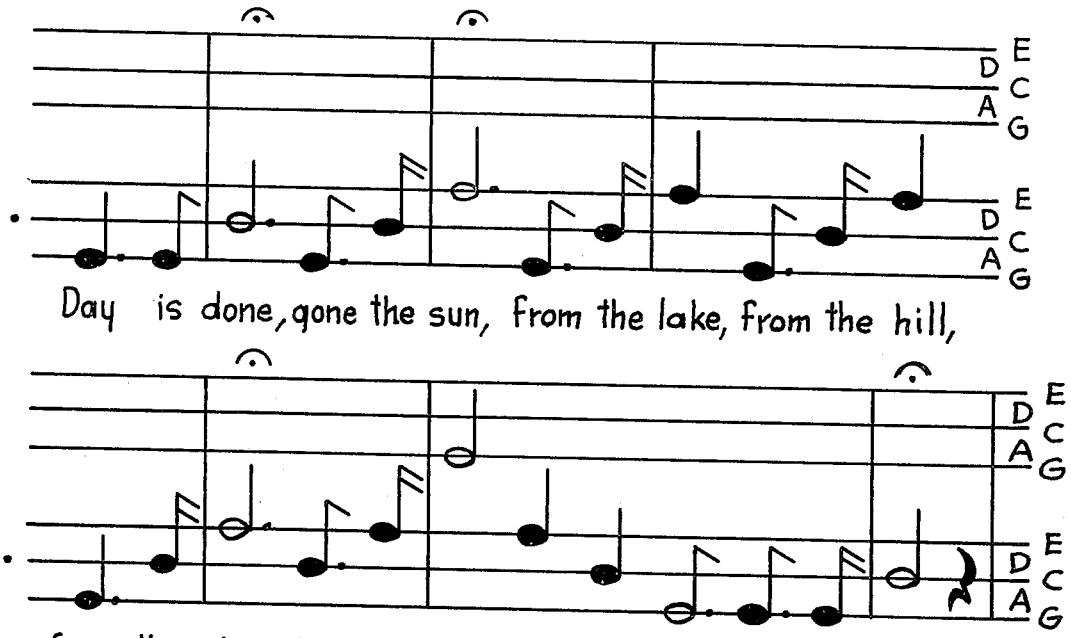
FIG. 4 shows music rewritten for playing on my pentatonic keyboard.

My pentatonic notation uses three-line staves as shown in FIG. 4. A dot on the left end of the center line of one staff represents the middle C digital. Other staves can represent octaves above or below the middle C octave. The three lines of each staff represent the tones G, C, E which form an inversion of the major triad. The spaces between the lines in each staff represent the tones A and D.

On my keyboard, each upper digital playing E# is white and has a groove on top, while the other four upper digitals in the octave span are black and are flat on top. This irregularity provides a landmark which assists the player. For example, the C digital is the third lower digital to the right or left of each E# digital.

Many well known melodies may be played entirely on the lower digitals of my organ. The notes and words of "Taps" are shown in FIG. 4. In this case the notes, like all bugle notes, fall only on lines of the staff. Other well known melodies included in the tonal pentatonic scale are "Auld Lang Syne", "Comin' Thru' the Rye", "Swing Low, Sweet Chariot", "Nobody Knows the Trouble I've Seen".

With a keyboard containing several octaves of this pentatonic scale, it is possible to start on five different lower digitals and obtain sequences of musical intervals of 2, 2, 3, 2, 3, semitones, 2, 3, 2, 3, 2 semitones, 3,2,3,2,2 semitones, 3, 2, 2, 3, 2 semitones or 2, 3, 2, 2, 3 semitones. I include all five of these sequences as different modes of the same pentatonic scale, which in this case is commonly called the tonal pentatonic scale.

The first of the above modes is used in the above named melodies. The last mode above corresponds to the five tones do, re, fa, so, la of the diatonic scale. Since it starts seven semitones above the starting point of the first mode, melodies based on this mode would have as keynote the note G (In the pentatonic notation of FIG. 3 and 4). Thus the keynote of the most popular mode of the tonal pentatonic scale always falls on the center line of the staff, while the keynote of the next most popular mode always falls on the bottom line of the staff.

To help children remember which tones are associated with the lines and which with the spaces of the staff, I slightly change the traditional line syllable names do-mi-so to do-mo-so and the traditional space syllable names re-la to ra-la. This frees the names "re" and "mi" for those who use syllables ending in "e" and "i" to name the series of flats and sharps.

Figure 5:
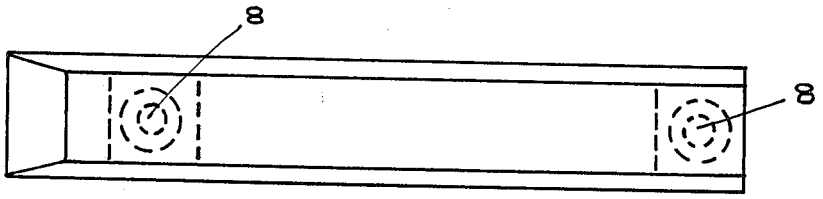
FIG. 5 shows a top view of a black upper digital block of my keyboard.
Figure 7:
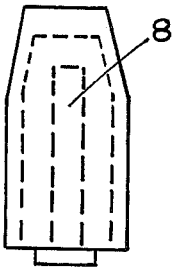
FIG. 7 shows an end view of a black upper digital block of my keyboard.
Figure 6:
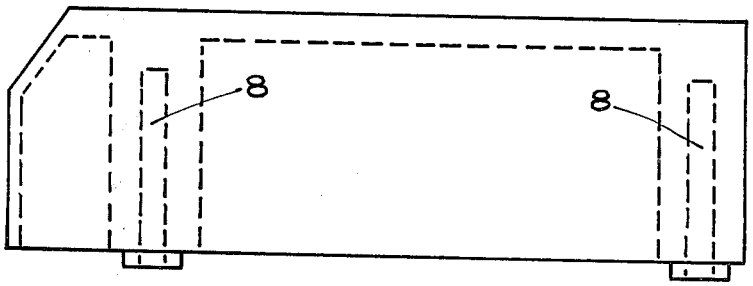
FIG. 6 shows a side view of a black upper digital block of my keyboard.
Figure 9:
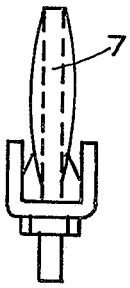
FIG. 9 is an end view of a key channel.
Figure 8:
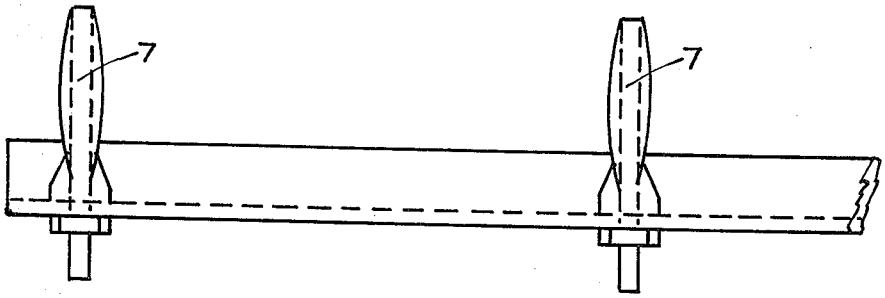
FIG. 8 is a side view of a key channel.

In order that my instrument may be useful to those trained in the traditional manner and having music written in the traditional manner, the lower digitals may be rearranged in the traditional pattern with seven lower digitals per octave span and groups of two and three black upper digitals per octave span. For this purpose the upper part of each upper digital, which I call the digital block, is made easily removable from its key channel. Referring to FIGS. 8 and 9, the screws which customarily hold the digital block to its key channel are replaced with banana plugs 7, which are well known expandible plugs commonly used as electrical connectors. FIGS. 5 and 7 show top and end views respectively of a digital block. FIG. 6 is a cross-sectional view showing how holes 8 in the upper part of each digital block are drilled out to receive the banana plugs 7. When the digital block is pressed down over its key channel, it is held firmly in place by friction with the two banana plugs.

Figure 10:
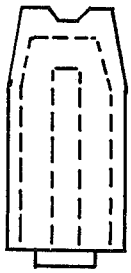
FIG. 10 is an end view of a white upper digital block.

When the keyboard is arranged for the diatonic scale, it has five black upper digitals per octave span, disposed as shown in FIG. 1. The inactive E# and B# upper digitals are white, and have a groove in the top, as shown in FIG. 10. When the keyboard is thus arranged to play in the diatonic scale, the connections between the tone generator circuits and the digital switches are changed by means of a scale selecting switch, diagramed in FIG. 11.

Figure 11:
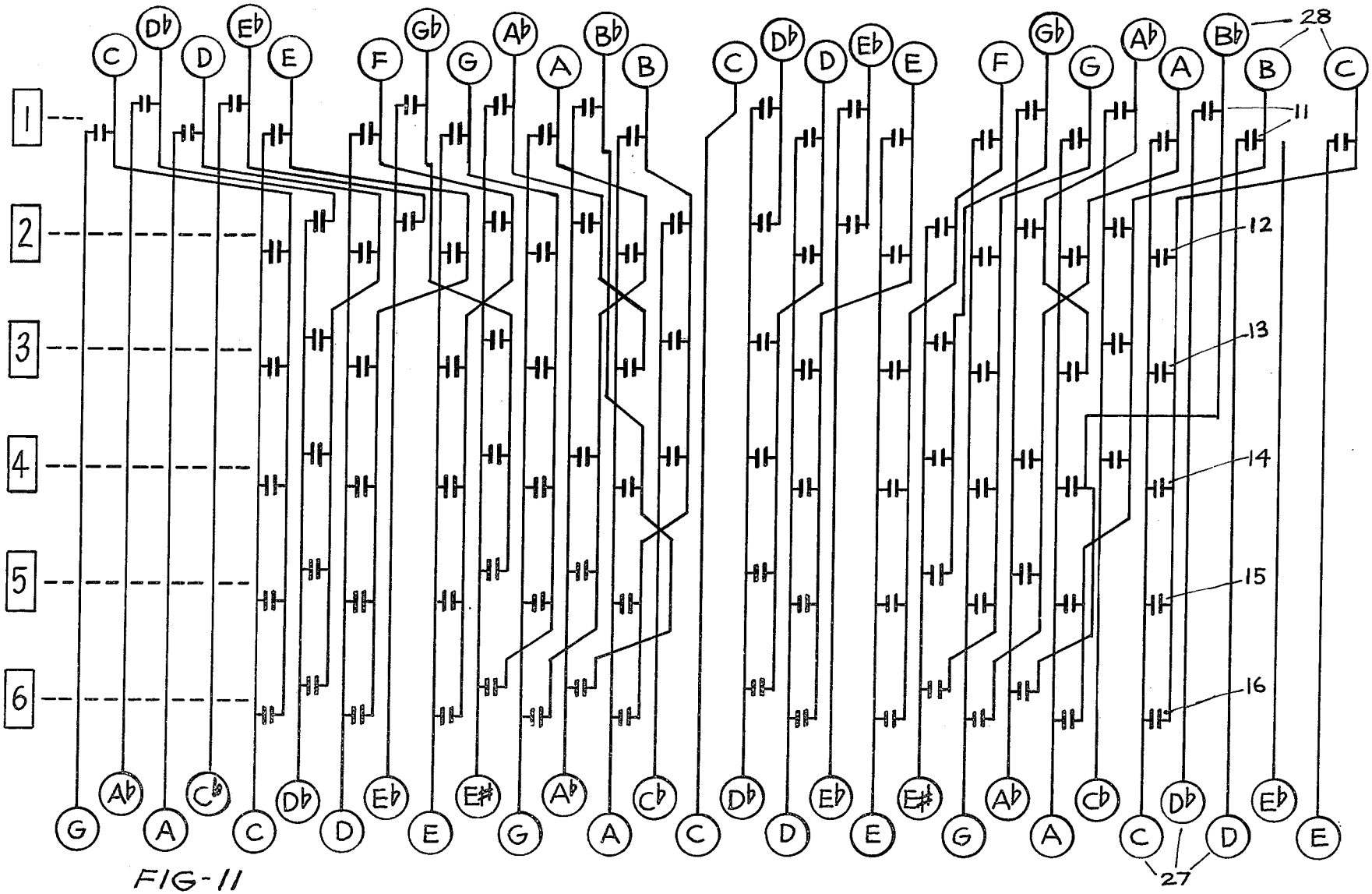
FIG. 11 is a wiring diagram of my scale selecting switch.

Referring to FIG. 11, pushbuttons 1, 2, 3, 4, 5, 6 are of the lock-release type. When one pushbutton is locked down, the previously locked pushbutton is released. Such arrays of switches, also termed interlocking switches, are well known. They are manufactured by ALCO Electronic Products, Inc., by UID Electronics Corporation, and by Standard Grigsby Division of Sun Chemical Corporation. Pushbutton 1 closes the array of switch contacts 11, pushbutton 2 closes an array of contacts 12, and so on. When pushbutton 1 is activated, digital terminals 27 are connected to tone terminals 28 so that the musical intervals corresponding to successive lower digitals above the C digitals are 2, 2, 1, 2, 2, 2, 1 semitones. This is the diatonic scale. Tone terminals 28 are identified by the traditional letter labels. Digital terminals 27 are labeled in accordance with the pentatonic notation of FIGS. 3 and 4.

Referring to FIG. 11, the middle C tone terminal is directly connected to the middle C digital terminal without intervention of switches When pushbutton 1 is locked down, the middle D♭, D, E♭, E tone terminals are connected to the middle D♭, D, E♭, E digital terminals. The F tone terminal is connected to a digital terminal labeled G in pentatonic notation. If the digital terminals were labeled in accordance with the traditional notation of FIG. 1, then when pushbutton 2 is locked down, the F tone terminal of FIG. 11 would be connected to the F digital terminal, the G♭ tone terminal would be connected to the G♭ digital terminal, and so on throughout the keyboard.

When pushbutton 2 is locked down, pushbutton 1 is released, switch array 12 is closed. Digital terminals 27 are then connected to tone terminals 28 with the same labels, so that the C, D, E, G, A tone terminals are connected throughout the keyboard to digital terminals labeled C, D, E, G, A. This is the tonal pentatonic scale. For clarity, I show only 25 tone terminals centered on middle C, connected to 29 digital terminals.

In addition to the diatonic and tonal pentatatonic scales, my scale selecting switch provides four other arrays of switch contacts which facilitate musical composition and playing in semitonal pentatonic scales. One of these four arrays of switches is closed by each of the pushbuttons 3, 4, 5, or 6 of FIG. 11.

Referring to FIG. 11, when pushbutton 3 is locked, switch array 13 is closed, and the C, D, E, F, G♭, G, A, and B tone terminals are connected to C, D♭, D, E, E#, G, A, C♭, digital terminals respectively. When pushbutton 4 is locked, switch array 14 is closed, and the same connections are made as in the pushbutton 3 case, except that the B♭ tone terminal is connected to the A digital terminal. The sequences of musical intervals corresponding to all six switch positions are shown in Table 1.

Table 1

| Switch Position | Scale | Interval Sequence |
|---|---|---|
| 1 | Diatonic | 2-2-1-2-2-2-1 |
| 2 | Tonal Pentatonic | 2-2-3-2-3 |
| 3 | Semi-tonal Pentatonic | 4-1-2-1-4 |
| 4 | Semi-tonal Pentatonic | 4-1-2-3-2 |
| 5 | Semi-tonal Pentatonic | 4-1-2-4-1 |
| 6 | Semi-tonal Pentatonic | 4-1-4-2-1 |

Table 2 shows the tones corresponding to each pentatonic digital for the five pentatonic scales of Table 1, using labels used conventionally for tones of the diatonic scale in the key of C. Each column corresponds to one of the pentatonic digitals as labeled in FIG. 3. The labels of the lines and spaces and of the digitals need not be changed when playing in the semitonal scales, but then the correspondence between the pentatonic note and digital names of the diatonic scale will be lost. This correspondence is particularly close for the tonal pentatonic scale, as may be seen in Table 2 by a comparison of the pentatonic digital names in the heating with the position 2 tones.

Table 2

| | Tones Corresponding to Pentatonic Digitals | | | | | | | | | | | |
|---|---|---|---|---|---|---|---|---|---|---|---|---|
| Pentatonic Digital | | D♭ | | E♭ | | E# | | A♭ | | C♭ | | |
| | C | | D | | E | | G | | A | | C | |
| Switch Position 2 | | D♭ | | E♭ | | F | | A♭ | | B | | |
| | C | | D | | E | | G | | A | | C | |
| 3 | | D | | — | | G♭ | | — | | B | | |
| | C | | E | | F | | G | | A♭ | | C | |
| | | D | | — | | G♭ | | A | | B | | |

Table 2-continued

| Pentatonic Digital | Tones Corresponding to Pentatonic Digitals | | | | | | | | | | | |
|---|---|---|---|---|---|---|---|---|---|---|---|---|
| | C | D♭ | D | E♭ | E | E# | G | A♭ | A | C♭ | C | |
| 4 | C | | E | | F | | G | | B♭ | | C | |
| 5 | C | D | E | — | F | G♭ | G | A | B | — | C | |
| 6 | C | D | E | — | F | G | A | B♭ | B | — | C | |

A scale selecting switch for selecting between the diatonic scale and the whole tone scale is disclosed in my U.S. Pat. No. 3,141,371. However, I have found that the tonal pentatonic scale is much more satisfactory than the whole tone scale for teaching music to beginners. The present invention therefore provides selection of pentatonic scales.

Figure 12:
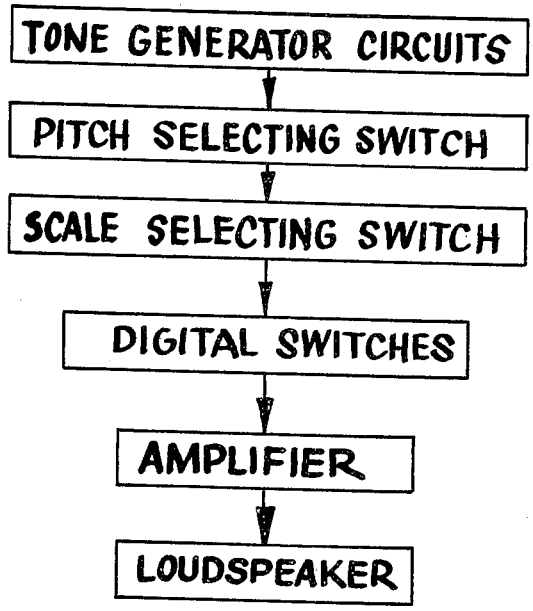
FIG. 12 is a block diagram showing a musical system using my scale selecting switch.

The relationship between my scale selecting switch and other components of my organ is shown in FIG. 12. The tone generator circuits are Hartley oscillators of a type well known in the organ industry. They oscillate continuously, and are made to sound by connection through digital switches to the amplifier and loudspeaker, as shown in FIG. 12. The amplifier and loudspeaker are of a conventional type well known in the organ industry. As shown in FIG. 12, my scale selector switch and an absolute pitch selecting switch are interposed between the tone generator circuits and the digital switches, with the pitch selector switch next to the tone generator circuits and the scale selector switch next to the digital switches. Thus the tone terminals 28 of FIG. 11 are connected to the tone generator circuits via the absolute pitch selecting switch. By means of this switch, the absolute pitch of the musical output can be adjusted to suit different voices.

Of course, when the music is altered by the absolute pitch selecting switch, the intervals between successive tones are characteristically unaltered; on the other hand, the scale selecting switch does change the intervals between tones corresponding to adjacent digitals on the keyboard, but it does not change the absolute pitch corresponding to middle C on the keyboard. The scale selecting switch and the absolute pitch selecting switch operate independently of each other.

Figure 13:
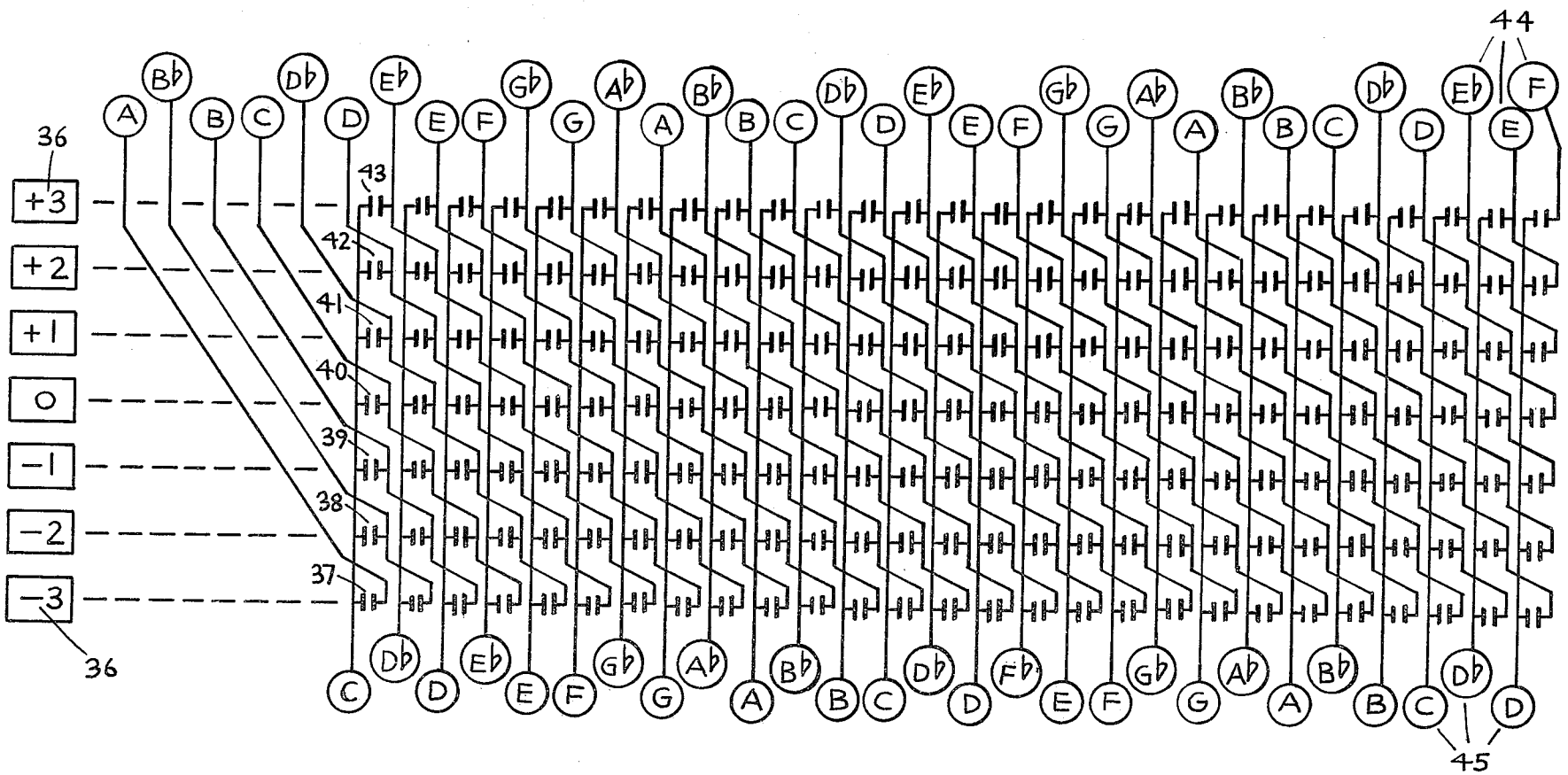
FIG. 13 is a wiring diagram of an absolute pitch selecting switch.

Referring to FIG. 13, showing an absolute pitch selecting switch, pushbuttons 36 are of the lock-release type like those shown in FIG. 11. The pushbutton marked 0 closes the array of contacts 40, the pushbutton marked +1 closes the array of contacts 41, and so on. Tone terminals 44 are connected to digital terminals 45 through one of the seven arrays of switches 37 . . . 43. For clarity, I show only 33 tone terminals connected to 27 digital terminals. In FIG. 13, both the tone terminals and the digital terminals are identified by use of the traditional notation.

When pushbutton 0 is locked down, the central array of contacts 40 is closed, the C digital terminal is connected to the C tone terminal, D digital terminal is connected to the D tone terminal, and so on. When pushbutton +1 is locked, pushbutton 0 is released, the array of contacts 41 is closed; the same digital terminals are each connected to tone terminals which produce absolute pitches one semitone higher. When pushbutton +2 is locked, the array of contaccts 42 is closed, the C digital terminal is connected to the D tone terminal, the D digital terminal is connected to the E tone terminal, and so on. No tone is sounded until one of the digitals in the keyboard is depressed. Absolute pitch selecting switches for keyboard instruments are well known. The present pitch selecting switch is like that shown in my U.S. Pat. No. 3,141,371.

Operation of the absolute pitch selecting switch does not necessarily affect the naming of the musical tones that result. For example, in FIGS. 4 and 3, the first two notes are read as G, the pentatonic G digital is struck, and the resulting tone may be called G regardless of which absolute pitch selector pushbutton is activated.

OTHER EMBODIMENTS

In the preferred embodiment of my invention, both the scale selecting switch and the array of digital switches carry audio frequency electric signals which are then amplified and made audible by means of a loudspeaker. In other embodiments, either or both switch arrays may instead carry direct current signals as shown in FIG. 14.

Figure 14:
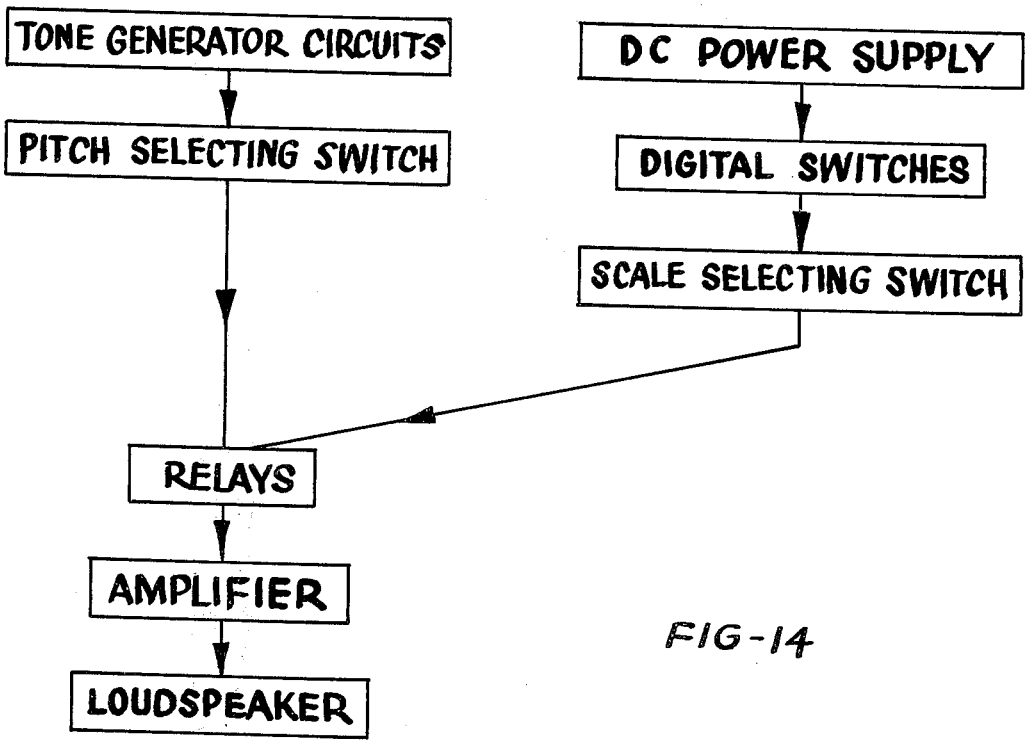
FIG. 14 is a block diagram showing other embodiments of my invention.

Referring to FIG. 14, the tone generator circuits, pitch selector switch, amplifier and loudspeakers are the same as in FIG. 12. The audio frequency signals in this case do not pass through the digital switches on their way to the loudspeaker; they instead pass through digitally-controlled relays. The power supply shown in FIG. 14 provides electrical power for the set of relays. These digitally controlled relays are preferably of the solid state switching type common in modern electronic organs. A description is found in: Crowhurst, Norman H., *Electronic Organs* Vol. 2, Howard Sams & Co., Inc., 1969, page 77–94. Individual relays are activated by DC currents generated in the DC power supply and keyed by individual digital switches.

The scale selecting switch may be located between the tone generator circuits and the relays, in which case it carries audiofrequency signals. But preferably it is located between the digital switches and the relays, as shown in FIG. 14. In this case the scale selecting switch carries D C signals which are used to activate audiofrequency signals.

While my invention has been described with reference to an electric organ, it is applicable to any other electrically keyed musical instrument such as a piano or accordian. In the case of an accordian, the terms "up" and "down" are to be understood as opposite directions normal to the plane of the keyboard. The term "keyboard" is used generically to include the pedalboard or clavier of an organ. The term "digital" includes the pedal. The tones controlled by the upper digitals may be different from those shown for the preferred embodiment. Some of the upper digitals may be omitted from the keyboard. The instrument is not necessarily equipped with an absolute pitch selector.

I claim:

1. An electrically keyed musical instrument having:

a keyboard containing a total of at least 25 digitals, including at least 15 lower digitals and at least 10 upper digitals, each upper digital activates at least one upper digital switch, each lower digital activates at least one lower digital switch, a plurality of tone generator circuits tunable in a twelve tone scale with 12 semitones per octave, scale selecting means having a plurality of operating states, providing electrical connections with said tone generator circuits and said digital switches such that pitches activated by said digitals always increase when proceeding from left to right on the keyboard, wherein the improvement comprises:

at least one of said operating states of said scale selecting means provides five lower digitals per octave span playing the tones of a pentatonic scale, and at least two upper digitals per octave span playing tone intermediate to the tones of said pentatonic scale.

2. The musical instrument of claim 1 in which one of said operating states provides seven lower digitals per octave span playing the seven tones of the diatonic scale.

3. The musical instrument of claim 1 in which said five lower digitals per octave span play the C, D, E, G, A tones constituting the tonal pentatonic scale.

4. The musical instrument of claim 1 including a source of electrical power, a plurality of at least 25 relays, each of said upper and lower digital switches activating at least one of said relays.

* * * * *